US006012842A

United States Patent [19]

Openiano

[11] Patent Number: 6,012,842

[45] Date of Patent: Jan. 11, 2000

[54] CONTAINER CONVERTIBLE BETWEEN A LIDDED SHOPPING BAG AND A PACKAGE VARIOUSLY SUITABLE AS GIFT WRAP OR FOR MAILING

[76] Inventor: Renato M. Openiano, 934 Fuchsia La., San Diego, Calif. 92154

[21] Appl. No.: 08/902,736

[22] Filed: Jul. 30, 1997

[51] Int. Cl.[7] ..... B65D 30/18; B65D 30/20; B65D 33/12

[52] U.S. Cl. ..... 383/6; 229/117.01; 229/146; 383/86

[58] Field of Search ..... 229/145, 146, 229/117.01, 117.05, 117.06; 383/6, 78, 80, 86

[56] References Cited

U.S. PATENT DOCUMENTS

| | | | |
|---|---|---|---|
| Re. 35,270 | 6/1996 | Polett | 383/80 |
| 380,364 | 4/1888 | Surles . | |
| 1,080,596 | 12/1913 | Selcer . | |
| 1,551,684 | 9/1925 | Mullery . | |
| 1,685,016 | 9/1928 | Blake . | |
| 1,722,931 | 7/1929 | Maloney | 383/86 |
| 1,866,241 | 7/1932 | Vineberg | 383/86 |
| 2,094,448 | 9/1937 | Evans . | |
| 2,358,790 | 9/1944 | Carruth . | |
| 2,394,926 | 5/1946 | Appel . | |
| 2,515,327 | 7/1950 | Bergstein . | |
| 2,970,628 | 2/1961 | Tames . | |
| 3,006,532 | 10/1961 | Fine . | |
| 3,049,281 | 8/1962 | Vines . | |
| 4,180,113 | 12/1979 | Liebling | 383/86 |
| 4,930,903 | 6/1990 | Mahoney | 383/6 |
| 5,725,310 | 3/1998 | Kruczko | 383/86 |

*Primary Examiner*—Stephen P. Garbe
*Attorney, Agent, or Firm*—Fuess & Davidenas

[57] ABSTRACT

A convertible container is formed from (i) a collapsible foldable five-sided open-ended bag in the substantial shape of a rectilinear body preferably having handles for use as an object-carrying, or shopping, bag, in combination with (ii) a collapsible foldable five-sided lid affixed to the bag at its open end for unfolding between (1) a collapsed position interior to the bag and (2) an expanded position fitting over the bag's open end. The lid is of dimension A×B with three sides of width A/2, and with one, dual-creased, side which is joined to the bag at an extension of width A. The two creases are each folded in a first sense to fit the lid within the interior of the bag, and are each folded in an opposite, second, sense to fit the lid upon the bag's open end, forming thereby a six-sided closed package which may variously be used as gift wrap or for mailing or the like.

9 Claims, 3 Drawing Sheets

CONTAINER CONVERTIBLE BETWEEN A LIDDED SHOPPING BAG AND A PACKAGE VARIOUSLY SUITABLE AS GIFT WRAP OR FOR MAILING

BACKGROUND OF THE INVENTION

1. Field of the Invention

The present invention generally concerns containers and packaging, including gift wrap, parcel packages and shopping bags such as are all commonly made from paper.

The present invention particularly concerns (i) high-quality typically-decorative rectilinear shopping bags such as are commonly made from strong, thick, and, occasionally, coated papers, in combination with (ii) parcel packages, parcel package papers, and parcel packing techniques both for presentation as gifts or, alternatively, mailing.

2. Description of the Prior Art

The present invention will be seen to concern a gift wrapping package that comes into use substantially completely assembled (although pre-assembly is not the gravamen of the present invention).

U.S. Pat. No. 4,930,903 to Mahoney for a GIFT WRAPPING PACKAGE shows a gift wrap package including a paper bag of conventional type having a square folded bottom and side folds providing a bag of generally rectilinear shape. An insert inside the bag supports one or more of the bag sides and gives the bag the appearance of a box. A rectilinear lid closes the open mouth of the bag. In one embodiment, a pair of handles are affixed to the bag and extend through slots in the lid. In another embodiment, the handles are attached to an intermediate portion of the bag and extend alongside the lid. Suitable ribbons or bows may be applied to the package.

U.S. Pat. No. 5,245,815 to Savage for a PRE-WRAPPED GIFT PACKAGE provides a method of forming a pre-wrapped gift package which appears to have been hand wrapped. The method includes forming a sheet of box construction material with decorative paper affixed thereto into a box tube by joining ends thereof. The box construction material is properly creased and provided with flaps so that a consumer may fold the flattened box tube into a box so that the end flaps form ends of the box and the decorative paper forms a pair of paper flaps which may be overlapped and taped. A flattened pull bow is provided to form a gift wrapping kit with the flattened box tube which may be distributed and displayed in a flat package.

U.S. Pat. No. 5,518,313 to McAdam for a GIFT WRAP AND CONTAINER ASSEMBLY shows a flat wrapping container assembly adapted to be folded to form a container having a frame-like support structure disposed therein. The assembly includes a thin, flat sheet of flexible wrapping material and a foldable support structure, which has a center panel and a plurality of outer panels forming frame arms extending outward from the center panel adhered to an inside surface of the sheet. The support structure further has fold lines between the center panel and the outer panels that are adapted to allow the outer panels to pivot upward above the center panel about the fold lines. A pull cord is attached to the flexible wrapping material and to the support structure and is adapted to draw the outer panels and portions of the sheet extending therebetween upward above the center panel when opposite ends of the pull cord are pulled outward away from the center panel, thereby forming a container around an article positioned on the center panel.

The present invention will also be seen to concern a shopping bag combining another function at a later time than use of the bag for shopping.

It is known in the prior art to combine various functions with a shopping bag. U.S. design Pat. No. D274,104 to Bockus shows a COMBINED FOLDING SEAT AND SHOPPING BAG. U.S. Design Pat. No. D332,696 to Kendrick shows a COMBINED SHOPPING BAG AND COUPON STORAGE ORGANIZER. U.S. Pat. No. 4,078,595 to Mittelmann is for a COMBINATION HANDBAG AND SHOPPING BAG.

U.S. Pat. No. 4,117,874 to Berenguer for a PORTABLE ARTICLE CARRIER concerns a bag, e.g. a shopping bag, which is made of foldable material, is provided with a case, smaller than the bag, secured to the bag adjacent the mouth thereof. The case has two compartments, one of which serves for storage of the bag, when appropriately folded, and the other of which can be used as a purse. The bag can thus be conveniently packed away in the case when not in use.

A more extensive device is shown and described in U.S. Pat. No. 4,011,898 to Hubbard. The Hubbard device comprises a combined wallet, shopping bag, and over-the-shoulder purse for carrying miscellaneous articles. It includes a vinyl sheet having two half portions connected together along a central crease line, a zipper along the borders of the half portions for connecting the two half portions together when the latter are folded over on the central crease line, a zippered pocket opening in each of the half portions of the vinyl sheet, a foldable cloth bag, for example of nylon or acetate, having a bottom sewn to the vinyl sheet with the sidewalls extending substantially from the edges of the vinyl sheet, the bag being foldable and containable within the vinyl sheet when the half portions thereof are folded over and held together by being zippered along their borders, the vinyl sheet forming the interior bottom portion of the bag when the latter is pulled inside-out, and a pair of foldable handle straps stitched to the outside of the bag sidewalls adjacent the top edges thereof for carrying the device as a shopping bag.

The Hubbard device further includes a shoulder strap that is suspended from loops sewn to the outside surface of the bag sidewalls at a selected distance from the top edge of the bag such that upon folding the bag inwardly down to the level of the shoulder strap, pulling the shoulder strap collapses the bag sidewalls to close the top of the bag, the shoulder strap then being slidable over the shoulder for carrying the device as an over-the-shoulder purse. In one embodiment the handle straps for hand carrying the bag are arranged to provide several of the loops for suspending the shoulder strap. In another embodiment loops separate from the handle straps are provided for suspending the shoulder strap to the sidewalls of the bag. In still another embodiment the means for carrying and closing the bag comprises a cord interlaced through eyelets that are arranged around the periphery of the bag adjacent the top thereof. Pulling the cord collapses the sidewalls of the bag to close the top. When evenly pulled to both sides of the bag, the loops of the cord enable the bag to be carried by hand as a shopping bag. When pulled to one side only, the single loop of the cord enables the bag to be carried over the shoulder as a purse.

SUMMARY OF THE INVENTION

The present invention contemplates a shopping bag having a hinged lid that, by operation of the lid, is easily convertible into a complete, six-surface, package for an object (perchance the same object(s) as were transported in the shopping bag). Some shopping bags convert into mailing and shipping containers, others into gift wrap packages.

A preferred embodiment of the present invention is as a container that is convertible from the substantial form of a shopping bag suitable to carry one or more objects to the substantial form of a package suitable to enclose one or more objects. The container includes a collapsible foldable five-sided bag in the substantial shape of a rectilinear body. The bag is open at a one end side. Handles to the five-sided bag are oppositely disposed about its open-end side so as to permit the handled bag when un-collapsed and un-folded to be used as an object-carrying, or shopping, bag.

Meanwhile a five-sided lid that is also collapsible and foldable is affixed to the bag at its open end. The lid is preferably so affixed by a hinge in the form of a fold line. The lid may be made integrally with the bag from one single rectangular piece of, typically, paper. If so made, wastage is extremely minuscule, typically less than 1%, totally without having any wasted layers and/or other structure in the folded assembly as might be characteristic of origami.

The lid hinges and folds between (i) a collapsed position interior to the bag along an interior side where it is non-interfering with use of the bag to carry an object, and (ii) an expanded position where it fits over the open-end side of the bag and about an adjacent portion of the bag's four adjacent sides as a complete lid, or cap, or crown. When so fitted the lid is complimentary in shape to, and completely encloses, the bag, serving as a sixth side.

In accordance with this construction, the lid is concealed within the bag during use of the bag as an object-carrying, or shopping, bag, and subsequently unfolds so as to enclose the bag, transforming it into a six-sided package suitable to enclose an object.

The bag and its preferably integral lid may be made from rough, but strong, papers such as, inter alia, kraft paper. In this case the package is suitable for mailing or the like, and may even be pre-printed with appropriate indicia for this function. The bag and its lid are preferably made from decorative, typically coated, paper of substantial strength and thickness as best suits the purpose of object containment. In this case the package is suitable as gift wrap, and may even accommodate that (i) the bag handles may tied to strongly secure the mounted lid and/or (ii) the bag-lid combination may be pre-fitted with ribbon suitably tied as a bow. The process is reversible if required or desired, permitting, for example, that a recipient of a wrapped object by gift and/or by mail might later carry it within the shopping bag in which it was delivered.

If desired the seam where the lid mounts upon the bag may be covered with a wide ribbon. The ribbon so used will then be located in an off-center location typical of finer gift wrapped packages, making that the combination bag-lid of the present invention will then be hard to distinguish from custom gift wrapping. Indeed, depending upon the quality of the base paper used, a package in accordance with the present invention is—with its sharp lines, excellent pattern alignment and precise corners as were all originally made by machine—normally of a quality comparable to the gift wrapping of professionals, and much superior to what than most amateurs typically achieve.

It will therefore be understood that, rather than producing a mediocre shopping bag in combination with a mediocre gift wrapping, the generally high-quality paper materials used to make the combination bag and lid of the present invention assure a shopping bag that is very upscale and stylish as well as, later, a gift wrap that is eminently suitable for presentation of the finest gifts.

These and other aspects and attributes of the present invention will become increasingly clear upon reference to the following drawings and accompanying specification.

DESCRIPTION OF THE PREFERRED EMBODIMENT

In accordance with the present invention, a single container is convertible from the substantial form of a shopping bag into a package suitable to enclose the object, and vice versa.

Figures 1, 1A, 2, 3, 4:
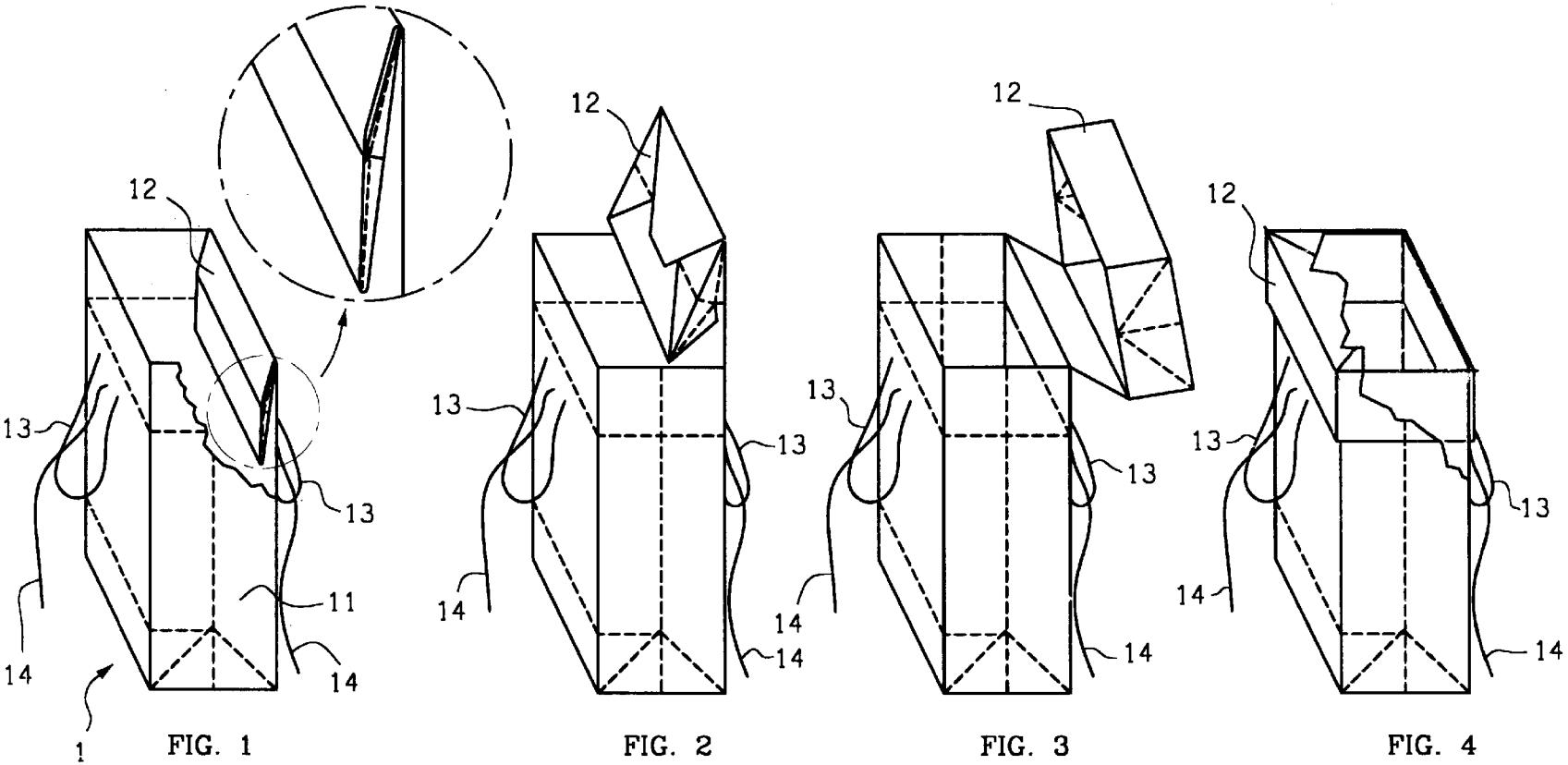
FIG. 1 is a diagrammatic perspective view, partially in cutaway, showing a preferred embodiment of a convertible container in accordance with the present invention that is convertible between (i) a lidded shopping bag and (ii) a package variously suitable as gift wrap or for mailing, the lid to the shopping bag being shown at its initial, stowed position.
FIG. 2 is a perspective view of the preferred embodiment of the convertible container in accordance with the present invention previously seen in FIG. 1, with the lid to the shopping bag now being shown at a first intermediary position between its stowed position of FIG. 1 and its mounted position of FIG. 4.
FIG. 3 is a perspective view of the preferred embodiment of the convertible container in accordance with the present invention, previously seen in FIGS. 1 and 2, with the lid to the shopping bag now being shown at a second intermediary position between its stowed position of FIG. 1 and its mounted position of FIG. 4.
FIG. 4 is a long side plan view of the preferred embodiment of the convertible container in accordance with the present invention, previously seen in FIGS. 1 though 3, with the lid to the shopping bag being shown at its final, mounted, position.

A preferred container 1 is shown in perspective view in FIGS. 1 through 3, and in a long side plan view in FIG. 4.

The container 1 is based on a collapsible foldable five-sided bag 11 and a lid 12. The bag 11 is in the substantial shape of a rectilinear body. It is open at its one end, top, side.

Handles 13 are affixed to the bag 11 in each of two oppositely-disposed ones of its five sides. These handles are preferably made from polyester cord which, although more expensive than paper or twine, are both (i) comfortable to the touch, which best suits their function in the carrying of the bag, and (ii) bright and lustrous in appearance, which best suit their function (to be discussed) in the tying of the lid 12 to the bag 11.

The lid 12 has five sides: a top side and four sides (as are best seen in FIG. 3). The lid 12 is affixed to the bag 11 at its open end for unfolding between (i) a collapsed position interior to the bag 11 along an interior side where it is non-interfering with use of the bag 11 to carry an object (shown in FIG. 1), and (ii) an expanded position where it fits over the open-end side of the bag 11 and about an adjacent portion of the bag's four adjacent sides as a lid that is complimentary in shape to, and completely enclosing, the bag 11 (shown in FIG. 4). The lid 12 thus serves as a "sixth side" to the bag 11.

Both the bag 11 and the lid 12 are of the container 1 are preferably made from strong paper, and are more preferably made from printed and/or coated paper(s) by cutting, folding and gluing.

Clearly both the bag 11 and the lid 12 are rectilinear. As shown in the figures the lid 12 is affixed to the bag 11 (and the bag 11 to the lid 12) along a long edge of the bag's open-end side. This is not an absolute necessity: the lid 12 could have been affixed to the bag 11 along a short edge of the bag's open-end side. However, the bag 11 is normally creased and folded flat for transport and storage along its short sides, and affixation of the lid 12 to these sides can render this folding more complex, and less satisfactory. Accordingly, the preferred affixation of bag 11 and lid 12 is as illustrated.

Exactly how the lid 12 is so affixed and hinged to the bag 11 is not, and cannot be, equally clear in all figures, so some care must be given to understand both (i) the attachment, and (ii) how it folds. The clearest view of the attachment of the lid 12 to the bag 11 is perhaps FIG. 5, and particularly FIG. 5*a*. It will immediately be recognized that the lid 12 is not "tight" to the open end of the bag 11, meaning directly hinged only at the top lip of this opening, but instead "stands off" from the bag 11 by the width of material illustrated at "X" in FIGS. 5*a*, 5*b*. By convention, this material is considered part of the lid 12 because it would not appear (or would at least not appear extended, being most likely a glued interior reinforced edge seam) in a conventional shopping bag.

Figure 5B:
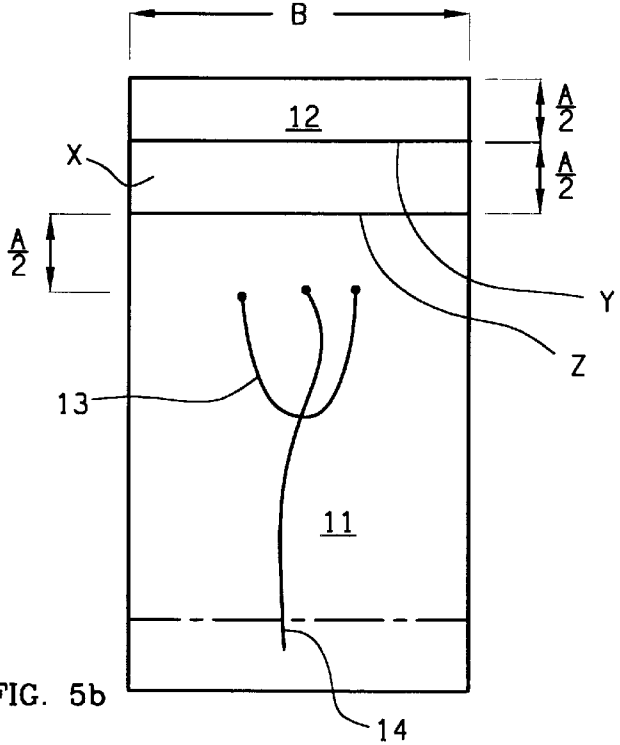
FIGS. 5*a* and 5*b* are, respectively, short side and long side plan views of the preferred embodiment of the convertible container in accordance with the present invention, previously seen in FIGS. 1 through 4, with the lid to the shopping bag maximally extended (such as might be encountered in mounting the lid).
Figure 5A:
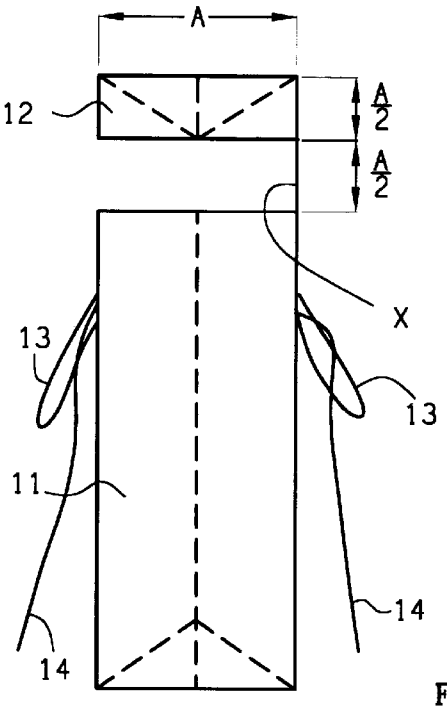

It is worth a few seconds to consider how the lid 12 hinges and bends to the bag 11—which clearly it does. When the lid 12 is hinged and folded to the interior of the bag 11 then it is so hinged and folded both along lines "Y" and "Z" as are shown in FIG. 5*b*. Once it is recognized that the fold line "Z" must incur a 180° bend so that the segment "X" may lie flat against the interior wall of the bag 11 as shown in FIG. 1, then it will be recognized that the fold line "Y" must likewise incur a 180° bend in the opposite sense. Meanwhile the lid 12 collapses along it fold lines are conventional for any open-sided rectilinear reservoir.

Of topological interest, when the lid 12 is mounted to the bag 11, the segment "X" will lie flat against the exterior wall of the bag 11 as is best shown in the detail of FIG. 4. At this time the fold lines "Y" and "Z" will again each incur 180° bend—only now in the opposite sense to their the manner in which each was bent when the lid 11 was in its stowed position of FIG. 1!

As well as the clever manner in which segment "X" and fold lines "Y" and "Z" permit angular positioning of the lid 12 relative to the interior, and exterior, of the bag 11, the relative dimensions of the lid 12 and bag 11 components are of consummate importance. Namely, there is a definite theory, and method, to the affixation of the bag 11 and the lid 12, and that theory and method is as follows. The five-sided lid 12 may be considered to have (i) a top side of dimension A×B where A and B are any arbitrary nonzero dimensions, (ii) a first edge side of length B each extending approximately A/2 from the top side, (iii) opposed second and third edge sides each of length A and each extending approximately A/2 from the top side, and (iv) a fourth edge side, opposite to the first edge side, of length B extending approximately a distance A from the top side until merging with a side of the rectilinear bag 11, where it is affixed. All these dimensions are illustrated in FIG. 5.

By this construction the fourth edge side of the five-sided lid may be folded along fold lines "Y" and "Z" that are parallel to the lid's top surface: fold line "Y" at a distance A/2 from the top surface and fold line "Z" at a distance A from the top surface where it merges with the side of the rectilinear bag. When the lid 12 is so bent and folded along the two fold lines "Y", "Z" of its fourth-edge side each in a first directional sense then it is lodged within the bag (see FIG. 1). However, when the lid 12 is bent and folded along the two fold lines "Y", "Z" of its fourth-edge side each in an opposite, second, directional sense, then the lid 12 encloses the bag 11 so as to make it into the six-sided package (see FIG. 4).

There are intermediary positions of the lid 12 between its positions inside, and capping, the reservoir of the bag 11 (see, e.g., FIGS. 2 and 3). These positions are aesthetically satisfactorily appearing, somewhat useful, and completely non-injurious to the container 1 of its subsequent uses as either a shopping bag or a sealable package. Basically a lid 12 that is withdrawn from the bag 11 but not completely firmly seated as a cover over its open end side will act as a substantial "flap" (albeit one not "hinged" in precisely the proper position, to the shopping bag. This "flap" may beneficially help in (i) preventing items held within the reservoir of the bag 11 from spilling out, or (ii) shielding these items from rain and snow. The lid 12 may always be moved bi-directionally between, and through, all positions that it may assume.

Further in construction of the convertible container 1, the handles 13 to the five-sided bag 11 are preferably spaced at a distance A/2 (or greater) from the bag's open-end side, as shown in FIG. 5*b*. This makes that the handles 13 will still be exposed and accessible when the lid 12 encloses the bag 11 so as to make it into the six-sided package. The exposed handles 13 are preferably sufficiently long so as to tie over the lid 12 when the lid 12 encloses the bag 11 in order to make the bag 11 into the six-sided package. When so tied the handles 13 help secure the lid 12 to the bag 11. Those with a command of math, and good spatial visualization, will be able to calculate that each handle should be at least 2A in length, and typically so much more as may accord for tying a knot.

The container 1 may further, optionally, have and present ties 14 that are, as illustrated, extending from oppositely-disposed surfaces of the bag 11. These ties 14 also are preferably spaced at greater than the distance A from the open-end side of the bag 11, making that they are also exposed and accessible when the lid 11 encloses the bag 12 so as to make it into the six-sided package.

The ties 14 are also preferably sufficiently long so as to tie over the lid 12 when the lid 12 encloses the bag 11 so as to make both into the six-sided package. The ties 14 also help secure the lid 12 to the bag 11.

Figure 6:
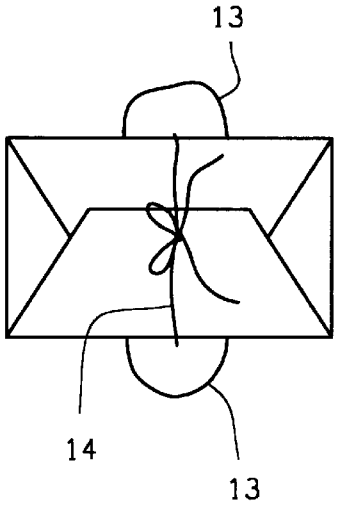
FIG. 6 is an end side plan view of the lid to the preferred embodiment of the convertible container in accordance with the present invention, previously seen in FIGS. 1 through 5, with the lid being tied in its position mounted to the shopping bag by optional ribbons but not, at least yet, tied by the handles to the bag.

An end side plan view of the lid 11 to the preferred embodiment of the convertible container 1 in accordance with the present invention is shown in FIG. 6. The lid 12 is tied in its position mounted to the shopping bag 11 (not shown in FIG. 6, shown in FIGS. 1–5) by optional ribbons 14. The lid 12 is not shown, at least yet, to tied by the handles 13 to the bag.

Figure 7:
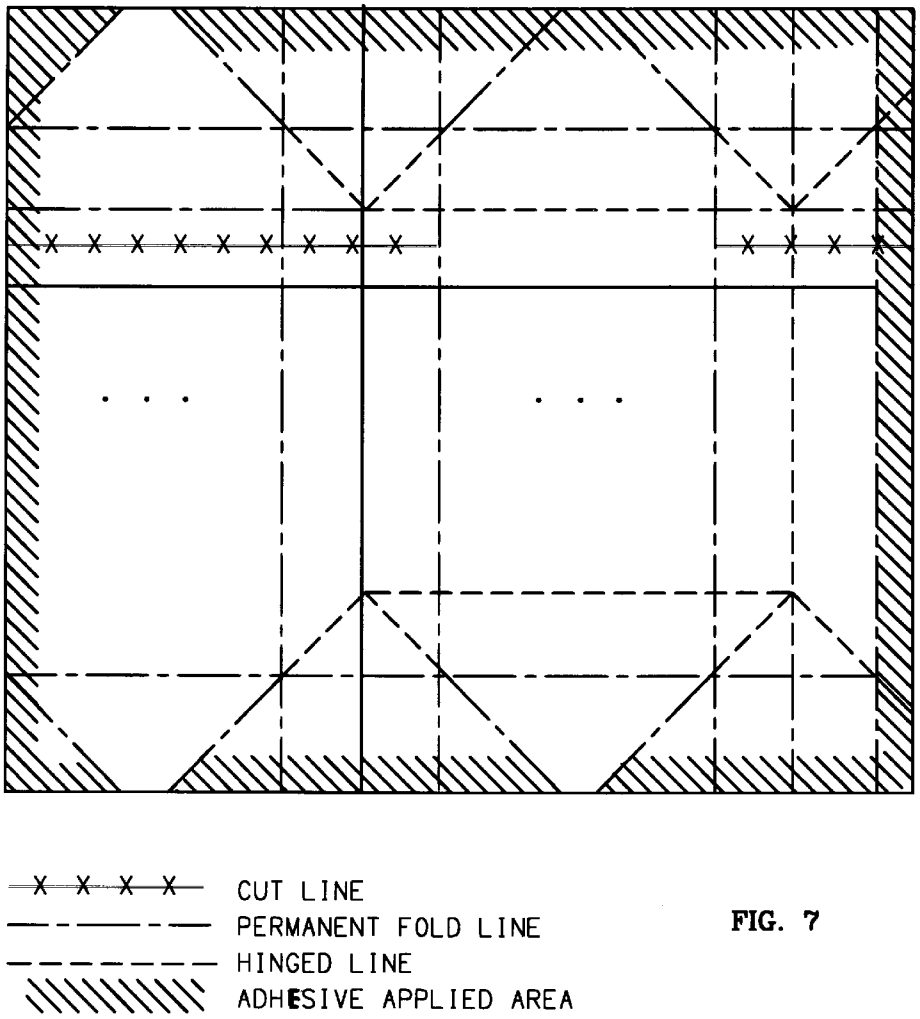
FIG. 7 is a plan view of a template for the integral construction of the preferred embodiment of the convertible container in accordance with the present invention in both its (i) shopping bag and (ii) lid parts.

A plan view of a template for the construction of the preferred embodiment of the convertible container 1 in accordance with the present invention integrally in both its (i) shopping bag and (ii) lid parts is shown in FIG. 7. The legend indicates (i) areas to which adhesive is applied, and which are permanently glued upon (machine) assembly of the bag. Likewise, each of the (ii) cut lines, (iii) permanent fold lines, and (iv) hinged, or moveable, fold lines used to make the convertible container 1 are shown. Notably, and although two spaced-parallel cut lines that are very, very slight separated (normally but a fraction of a centimeter) may be employed (to facilitate the later stages of machine assembly), thus "wasting" two very narrow strips of paper, it is immediately striking from observation of FIG. 7 that there is veritably no wastage. Normally wastage is less than one percent (1%). Equally importantly, the container 1 is substantially devoid of wasted layers and/or other structure ( such as might be characteristic of origami). In other words, both the lid 12 and the bag 1, and their connection, are built quite normally, and without any abnormal wastage of material. A topologist may not find it surprising that a lid that fits to a bag will be formed from a continuation of the same rectangular piece of material from which the bag itself is formed. It is only a little less obvious that the "void" opened up by the connecting region "X" (shown in FIG. 5) frees material to be used for the necessary folded seams at the lips of the openings to each of the lid 12 and the bag 11.

In accordance with the preceding explanation, variations and adaptations of the convertible container in accordance with the present invention will suggest themselves to a practitioner of the mechanical and packaging arts. For example, all sorts of indica and patterns can be impressed, for decorative and/or functional purposes (e.g., advertising). It is possible to make the lid 12 detachable, or even frangible, from the bag 11 in order that those persons coming into possession of the container 1—in a department store, perhaps—who simply cannot abide the insignificant volume occupied by the un-deployed lid 12 inside the bag 11 may rip out the lid 12, and discard it. For example, it is possible to make additional, and/or additionally decorative, handles 13 and/or ties 14, and even to pre-package suitable lengths of ribbon, address labels, gift labels, etc., etc. inside the bag 11.

Clearly the goal of the invention, and of the container 1, is to carry one or more objects at a first time, and to package these or other objects at a second time. More than that, the element of surprise may be maintained by the simple expediency of "closing the lid" to prevent that items purchased while shopping should be momentarily partially exposed in malls, cars or homes to other persons. A "lidded" shopping bag may promote security, and help to prevent theft from the bag. The contents of a lidded bag are protected against the elements, and against spillage from the bag. Conversely, a customer with a closed-lid bag may be perceived by stores to be at greater risk of successfully concealing shoplifted articles, although presumptively the store's exit security would make even a lidded shopping bag a poor place to attempt to hide stolen items.

In accordance with these and other possible variations and adaptations of the present invention, the scope of the invention should be determined in accordance with the following claims, only, and not solely in accordance with that embodiment within which the invention has been taught.

What is claimed is:

1. A container convertible from the substantial form of a shopping bag suitable to carry an object to the substantial form of a package suitable to enclose the object, the container comprising:

a collapsible foldable five-sided bag in the substantial shape of a rectilinear body, the bag being open at a one end side;

handles attached to the five-sided bag in positions oppositely disposed about the bag's open-end side so as to permit the handled bag when un-collapsed and un-folded to be used as an object-carrying, or shopping, bag;

a collapsible foldable five-sided open-ended lid permanently hinged to the bag at the bag's open end for undergoing hinging motion and also folding and unfolding along predetermined crease lines between (i) a first hinged position where the lid is located folded interior to the bag along a side of the bag at which first hinged position the lid is non-interfering with use of the bag to carry an object, and (ii) a second hinged position located exterior to the bag along an the same side of the bag at which second hinged position the lid unfolds so as to fit over the open-end side of the bag and about an adjacent portion of the bag's four adjacent sides as a lid complimentary in shape to, and completely enclosing, the bag as a sixth side thereof;

wherein the lid is concealed within the bag during use of the bag as an object-carrying, or shopping, bag and does subsequently undergo hinging motion and also unfold so as to enclose the bag, transforming both the bag and the lid in combination into a six-sided package suitable to enclose the object.

2. The convertible container according to claim 1 wherein the bag is rectilinear;

wherein the lid is rectilinear; and wherein the lid is affixed to the bag, and the bag to the lid, along a long edge of the bag's open-end side.

3. A container convertible from the substantial form of a shopping bag suitable to carry an object to the substantial form of a package suitable to enclose the object, the container comprising:

a collapsible foldable five-sided rectilinear bag, the bag being open at a one end side;

handles attached to the five-sided bag in positions oppositely disposed about the bag's open-end side so as to permit the handled bag when un-collapsed and un-folded to be used as an object-carrying, or shopping, bag;

a collapsible foldable five-sided rectilinear lid affixed to the bag at its open end for unfolding between (i) a collapsed position interior to the bag along an interior side where it is non-interfering with use of the bag to carry an object, and (ii) an expanded position where it fits over the open-end side of the bag and about an adjacent portion of the bag's four adjacent sides as a lid complimentary in shape to, and completely enclosing, the bag as a sixth side thereof, the five-sided lid having a top side of dimension A×B, a first edge side of length B extending approximately A/2 from the top side, opposed second and third edge sides each of length A and each extending approximately A/2 from the top side, and a fourth edge side, opposite to the first edge side, of length B extending approximately a distance A from the top side until merging with a side of the rectilinear bag, where it is affixed;

wherein the fourth edge side of the five-sided lid is folded along fold lines parallel to the lid's top surface once at a distance A/2 from the top surface, and again at a distance A from the top surface where it merges with the side of the rectilinear bag;

wherein the lid is bent and folded along the two fold lines of its fourth-edge side each in an associated first directional sense when the lid is folded within the bag, and each in an associated opposite, second, directional sense when the lid encloses the bag so as to make both bag and lid in combination into the six-sided package;

wherein the lid is concealed within the bag during use of the bag as an object-carrying, or shopping, bag and does subsequently unfold so as to enclose the bag, transforming both the bag and the lid in combination into a six-sided package suitable to enclose the object.

4. The convertible container according to claim 3 wherein the handles to the five-sided bag are spaced greater than a distance A from the bag's open-end side;

wherein the handles are still exposed and accessible when lid encloses the bag so as to make both in combination into the six-sided package.

5. The convertible container according to claim 4 further comprising:

ties attached to the five-sided bag in positions oppositely disposed about the bag's open-end side;

wherein the ties are sufficiently long so as to tie over the lid when the lid encloses the bag in order to make both in combination into the six-sided package;

wherein the ties help secure the lid to the bag.

6. The convertible container according to claim 3 further comprising:

ties extending from oppositely-disposed surfaces of the bag.

7. The convertible package according to claim 6 wherein the ties to the five-sided bag are spaced greater than a distance A from the bag's open-end side;

wherein the ties are still exposed and accessible when the lid encloses the bag so as to make it into the six-sided package.

8. The convertible container according to claim 7 wherein the ties are sufficiently long so as to tie over the lid when the lid encloses the bag so as to make both in combination into the six-sided package;

wherein the ties help secure the lid to the bag.

9. A container convertible from a shopping bag to a package comprising:

a collapsible foldable five-sided shopping bag in the substantial shape of a rectilinear body, the bag being open at a one end side;

a collapsible foldable five-sided lid in the substantial shape of a rectilinear body open at one side, the lid complimentary to the bag to fit over the open end side of the bag; and a strip connecting the lid to the bag along an open side edge of each, the strip being hinged at the open side edge of the bag to greatly bend to lie against either an adjacent interior or exterior wall of the bag, and the strip likewise being hinged at the open side edge of the lid to greatly bend to lie against either an adjacent interior or exterior wall of the lid;

wherein the hinged strip may be bent in a first directional sense at each of its hinged connections to the bag and to the lid in order to permit a collapsed lid to lie against the interior wall of the bag; and wherein the hinged strip may be bent in a second directional sense, opposite to the first directional sense, at each of its hinged connections to the bag and to the lid in order to permit an expanded lid to fit over the end opening of the bag;

wherein the five-sided lid has a top side of dimension A×B and two edge sides of length B each extending approximately A/2 from the top side, and two edge sides of length A each extending approximately A/2 from the top side; and wherein the strip is of width A/2 between its hinged connection to both the rectilinear bag and the rectilinear lid.

* * * * *